US007275578B2

(12) United States Patent
Mitsui et al.

(10) Patent No.: US 7,275,578 B2
(45) Date of Patent: Oct. 2, 2007

(54) TRANSFER DEVICE

(75) Inventors: Takashi Mitsui, Osaka (JP); Hideto Shima, Kyoto (JP)

(73) Assignee: Kokuyo Co., Ltd. (JP)

( * ) Notice: Subject to any disclaimer, the term of this patent is extended or adjusted under 35 U.S.C. 154(b) by 327 days.

(21) Appl. No.: 11/013,329

(22) Filed: Dec. 17, 2004

(65) Prior Publication Data

US 2005/0150605 A1 Jul. 14, 2005

(30) Foreign Application Priority Data

Dec. 26, 2003 (JP) ..... P2003-435446

(51) Int. Cl.
*B32B 37/26* (2006.01)
*B26F 3/02* (2006.01)

(52) U.S. Cl. ..... 156/523; 156/577; 118/76; 118/257; 242/160.4; 242/171; 242/588.6

(58) Field of Classification Search ..... 156/523, 156/527, 538, 540, 574, 577, 579; 118/76, 118/200, 257; 225/46; 242/160.2, 160.4, 242/170, 171, 588, 588.2, 588.3, 588.6; 206/411
See application file for complete search history.

(56) References Cited

U.S. PATENT DOCUMENTS 5,346,580 A * 9/1994 Elges et al. ..... 156/540
5,942,036 A * 8/1999 You ..... 118/257
6,000,455 A * 12/1999 Semmler ..... 156/540
2004/0149392 A1* 8/2004 Casaldi et al. ..... 156/574

FOREIGN PATENT DOCUMENTS

JP 2002144790 A * 5/2002
JP 2002-178694 A 6/2002

* cited by examiner

*Primary Examiner*—Mark A Osele
(74) *Attorney, Agent, or Firm*—Banner & Witcoff, Ltd.

(57) ABSTRACT

A transfer device for transferring a transferring material to an object comprises a refillable cartridge that holds at least the transferring material, a case that accommodates the refillable cartridge detachably, a sliding member that is mounted on the case and that can make a sliding movement relative to the case, and a separating mechanism that separates the refillable cartridge from the case. The separating mechanism moves the refillable cartridge linearly in a direction that is different from a sliding direction of the sliding member when the sliding member makes the sliding movement. The case comprises a guiding portion that extends in the direction different from the sliding direction of the sliding member and the refillable cartridge comprises a guided portion that is guided by the guiding portion when the sliding member makes the sliding movement.

34 Claims, 4 Drawing Sheets

(a)

(b)

TRANSFER DEVICE

BACKGROUND OF THE INVENTION AND RELATED ART STATEMENT

This invention relates to a transfer device that is used for transferring a transferring material on an object on which the transferring material is to be transferred.

Various transfer devices have been conceived that are used in case of transferring a transferring material such as a tape like an adhesive tape or a non-adhesive tape, a solid or liquid paste or a binding agent on an object on which the transferring material is to be transferred such as papers or leaves. For example, a known transfer device comprises a refillable cartridge that can hold a transferring material and a transfer head to make the transferring material contact with an object on which the transferring material is to be transferred, and a case that accommodates the refillable cartridge detachably. In accordance with this arrangement, when all of the transferring material is used up or the transfer head is broken, commonly (for example, refer to patent document 1) a locked state of the refillable cartridge and the case is releaser, the refillable cartridge is dismounted from the case and then the dismounted refillable cartridge is exchanged with a new refillable cartridge comprising a new transferring material and a new transfer head.

(Patent document 1) Japan Patent Laid Open Number 2002-178694 (FIG. 2 or the Like)

However, for the transfer device of the above arrangement, since the refillable cartridge and the case are relatively tightly engaged each other, a user has to use his or her both hands in order to separate the refillable cartridge from the case, when the user exchanges the refillable cartridge, which makes it difficult to separate the refillable cartridge from the case. In addition, if the refillable cartridge is so designed to be flat to the case in a state that the refillable cartridge and the case are assembled in order to obtain a smooth touch when the transfer device is in use, it might be difficult for a user to recognize a boundary between the refillable cartridge and the case. As a result, it is not easy for the user to recognize how to operate which portion when he or she wants to exchange the refillable cartridge and an operation to exchange the refillable cartridge can be made further complicated. In addition, a transfer device can be conceived whose arrangement is; engaging portions are arranged to be engaged each other on a distal end portion of a case and a distal end portion of a refillable cartridge, in order to dismount the refillable cartridge from the case, the refillable cartridge is rotated by making use of the engaging portions as a fulcrum, and the refillable cartridge is so set to be dismounted from the case by making use of a structure wherein a distance between the rear end portion of the case and the rear end portion of the refillable cartridge becomes larger when the refillable cartridge is rotated, on the one hand in order to mount a new refillable cartridge on the case, each distal end portions of the case and the new refillable cartridge are engaged each other and the new refillable cartridge is rotated by making use of the engaged portion as a fulcrum. However, in accordance with the transfer device of this arrangement, a complicated operation such that the refillable cartridge is rotated is required to exchange the refillable cartridge, it is difficult for a user who is not familiar with thus arranged transfer device, especially for a user who uses this transfer device for the first time, to exchange the refillable cartridge smoothly, resulting in a problem of being low in terms of usability. In addition, the transfer device of this arrangement has another problem that it is difficult for a user to recognize how to exchange the refillable cartridge.

In order to solve the above-mentioned problems, the present claimed invention mainly intends to provide a transfer device wherein a refillable cartridge can be exchanged smoothly with a simple operation.

SUMMARY OF THE INVENTION

The transfer device of the present claimed invention is a transfer device used for transferring a transferring material on an object on which the transferring material is to be transferred, comprises a refillable cartridge that holds at least the transferring material, a case that accommodates the refillable cartridge detachably, and a sliding member that is mounted on the case and that can make a sliding movement relative to the case, wherein the refillable cartridge and the case are separated through a separating mechanism that moves the refillable cartridge linearly toward a predetermined direction that is different from a sliding direction of the sliding member in conjunction with the sliding movement of the sliding member, and is characterized by that a guiding portion that extends toward the direction different from the sliding direction of the sliding member is arranged on the case and a guided portion that is guided by the guiding portion in conjunction with the sliding movement of the sliding member is arranged on the refillable cartridge.

In accordance with this arrangement, since the refillable cartridge can be separated linearly from the case toward a predetermined direction different from the sliding direction of the sliding member by sliding to move the sliding member, it is possible to separate the refillable cartridge from the case more easily compared with a conventional transfer device wherein a refillable cartridge is separated from the case by rotating the refillable cartridge, which makes it extremely easy to exchange the refillable cartridge holding the transferring material and the transfer head. In addition, since the guided portion is guided by the guiding portion extending along the predetermined direction different from the sliding movement of the sliding member, it is possible to exchange the refillable cartridge smoothly and precisely. In addition, since the guiding portion plays a role to recognize a position on which the refillable cartridge is to be mounted (a position where a new exchanged refillable cartridge is mounted), an operation to exchange the refillable cartridge can be further simplified effectively. In addition, in accordance with the arrangement, it is possible to solve a problem of a conventional transfer device that a considerable force is required with using both hands in order to exchange the transferring material. As a result, the refillable cartridge can be separated from the case even though a boundary between the refillable cartridge and the case is difficult to recognize.

As another concrete embodiment to obtain the above effect it is represented that a transfer device used for transferring a transferring material on an object on which the transferring material is to be transferred, comprises a refillable cartridge that holds the transferring material and a transfer head to make the transferring material contact with the object, a case that accommodates the refillable cartridge detachably, and a sliding member that is mounted on the case and that can make a sliding movement relative to the case, and that is so arranged that the refillable cartridge and the case are separated through a separating mechanism that moves the refillable cartridge linearly toward a predetermined direction that is different from a sliding direction of the sliding member in conjunction with the sliding movement of the sliding member, and is characterized by a guiding portion that extends toward the direction different from the sliding direction of the sliding member is arranged on the case and a guided portion that is guided by the guiding portion in conjunction with the sliding movement of the sliding member is arranged on the refillable cartridge.

As a concrete embodiment it is represented that the predetermined direction different from the sliding direction of the sliding member is a direction generally orthogonal to the sliding direction of the sliding member and the guiding portion extends along a direction generally orthogonal to the sliding direction of the sliding member. In order to separate the refillable cartridge from the case securely with a simple arrangement it is preferable that the separating mechanism comprises a projecting portion that is formed on the sliding member, and a separation initiating portion that is arranged on a sliding movement path of the projecting portion of the refillable cartridge and that makes an abutting contact with the projecting portion in accordance with the sliding movement of the sliding member and that separates the refillable cartridge linearly toward the predetermined direction different from the sliding direction of the sliding member. In this case, if each tapered face is formed on the projecting portion and the separation initiating portion respectively and the tapered faces make an abutting contact each other in the process of the sliding movement of the sliding member, the tapered face locating on the projecting portion climbs over the tapered face locating on the separation initiating portion in conjunction with the sliding movement of the sliding member, which makes it possible to separate the case from the refillable cartridge with ease.

Especially, if the refillable cartridge holds the transferring material and the transfer head that makes the transferring material contact with the object on which the transferring material is to be transferred, and a direction to operate the sliding member in order to separate the refillable cartridge from the case is set to be a direction opposite to a longitudinal axis of the transfer head supported by the refillable cartridge, the sliding member will not disturb a movement when the transfer device is in an ordinary use.

In addition, if the case comprises a first outside panel constituting one of outside walls of the transfer device and a standing panel standing generally orthogonal to the first outside panel from a predetermined area of a rim of the first outside panel, and the guiding portion is formed on the standing panel, it is possible to exchange the refillable cartridge with ease by using the standing panel.

In order to form the guiding portion and the guided portion with a simple arrangement, it is preferable that the guiding portion is a groove and the guided portion is a projecting portion that fits into the groove.

As a concrete embodiment of the groove it is represented that the groove is formed between a pair of ribs arranged on the standing panel, or the groove is a concave groove that is formed by setting a thickness of an area of the standing panel to be thinner than a thickness of its adjacent area. In addition, if the groove has an opening edge opening at one of the end portions of the groove and is so arranged that the projecting portion can be inserted from the opening edge, and an opening width of the groove is so set to be gradually wider toward the opening edge, it is possible to insert the projecting portion into the groove, thereby enabling to exchange the refillable cartridge easily and smoothly.

In addition, if the refillable cartridge comprises a second outside panel constituting an outside wall of the transfer device and an inside panel arranged to face the second outside panel and at least the transferring material is held by the second outside panel and the inside panel, it is possible to hold the transferring material and the transfer head between the second outside panel and the inside panel stably and it is also possible to exchange the refillable cartridge smoothly because the transferring material and the transfer head will not be dropped off unexpectedly during an operation of exchanging the refillable cartridge.

As an arrangement to assemble the second outside panel and the inside panel with ease, it is represented that the second outside panel and the inside panel are so arranged to be integrally assembled by fittingly inserting a projecting body arranged either one of the second outside panel and the inside panel into a cylindrical portion that is arranged on the other. In accordance with the arrangement, it is possible to make a state wherein the second outside panel and the inside panel are assembled good by fittingly inserting the projecting body into the cylindrical portion.

If the projecting portion that fits into the groove is integrally formed with a periphery of the cylindrical portion, the projecting portion serves as a rib reinforcing the cylindrical portion, thereby enabling to enhance strength of the cylindrical portion.

In order to stabilize a movement of separating the refillable cartridge from the case, it is preferable that multiple guiding portions are arranged on the case and multiple guided portions are arranged on the refillable cartridge to correspond to the guiding portions. Especially, if the guiding portions are arranged in a pair in an area adjacent to an upper edge portion of the case and an area adjacent to a lower edge portion of the case to face each other, and the guided portions are arranged in a pair in an area adjacent to an upper edge portion of the refillable cartridge and an are adjacent to a lower edge portion of the refillable cartridge to face each other, it is possible to separate the refillable cartridge from the case stably and it is also possible to simplify a manufacturing process of the transfer device by using the minimum component, the guiding portion and the guided portion.

In addition, if an engaging means is formed to engage the sliding member with the case at a sliding movement starting position, an operating portion is arranged so that a user can put his or her finger on the operating portion in case of operating the sliding member to slide and an engaged state of the engaging means can be released in accordance with an operation of the operating portion, it is possible to prevent the sliding member from moving unexpectedly when the transfer device is in use while facility of an operation to exchange the refillable cartridge is not damaged.

Furthermore, if a fitting nail is arranged on the refillable cartridge to project along the sliding direction of the sliding member and a fitting bore is arranged on the sliding member to fit over the fitting nail at a sliding movement starting position, it is possible to prevent the refillable cartridge from moving toward the predetermined direction different from the sliding movement of the sliding member unexpectedly when the transfer device is in use.

DETAILED DESCRIPTION OF THE PREFERRED EMBODIMENTS

An embodiment of the present claimed invention will be described in detail with reference to the accompanying drawings.

Figure 1:
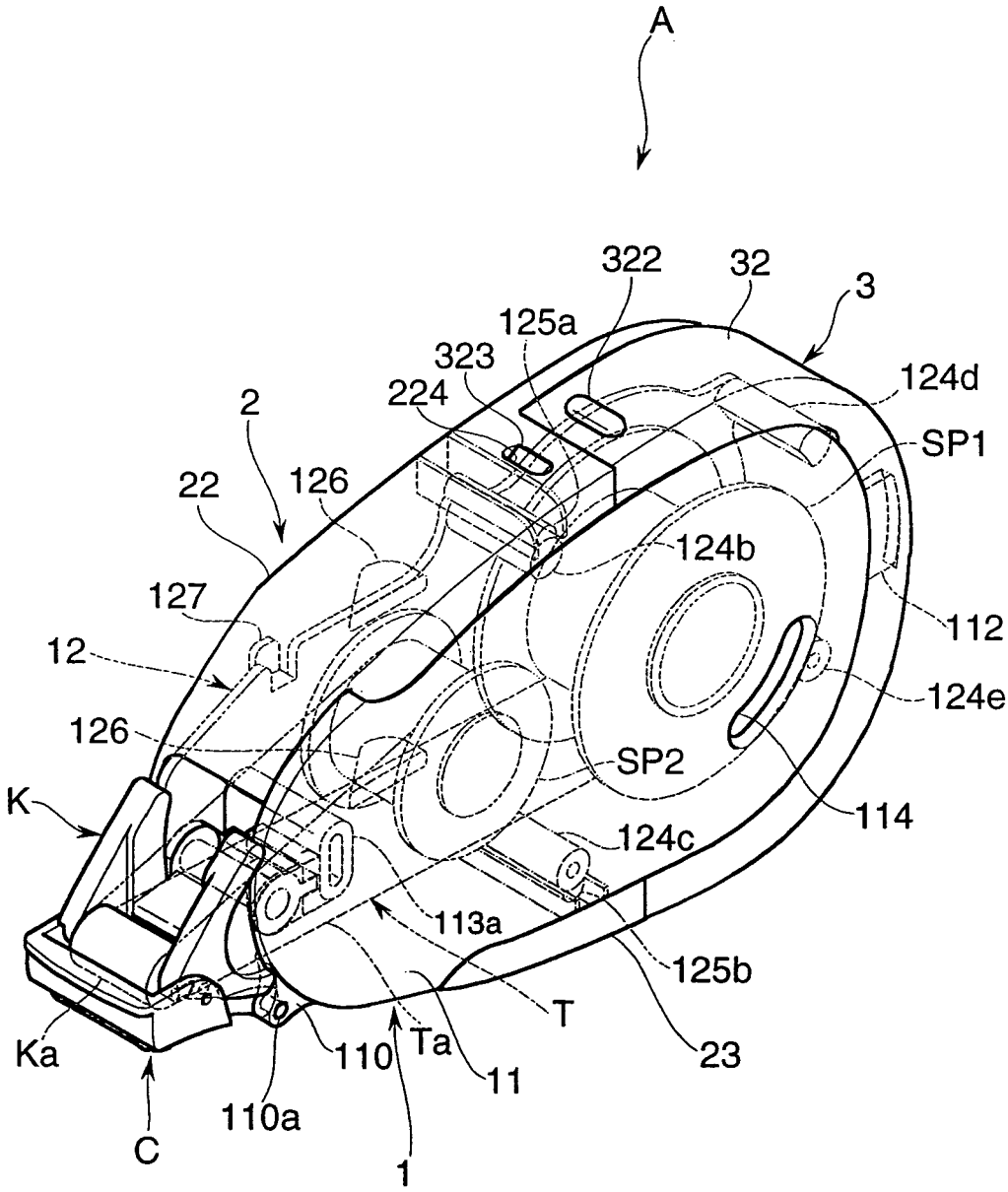
FIG. 1 is a general perspective view showing a transfer device in accordance with one embodiment of the present claimed invention.
Figure 2:
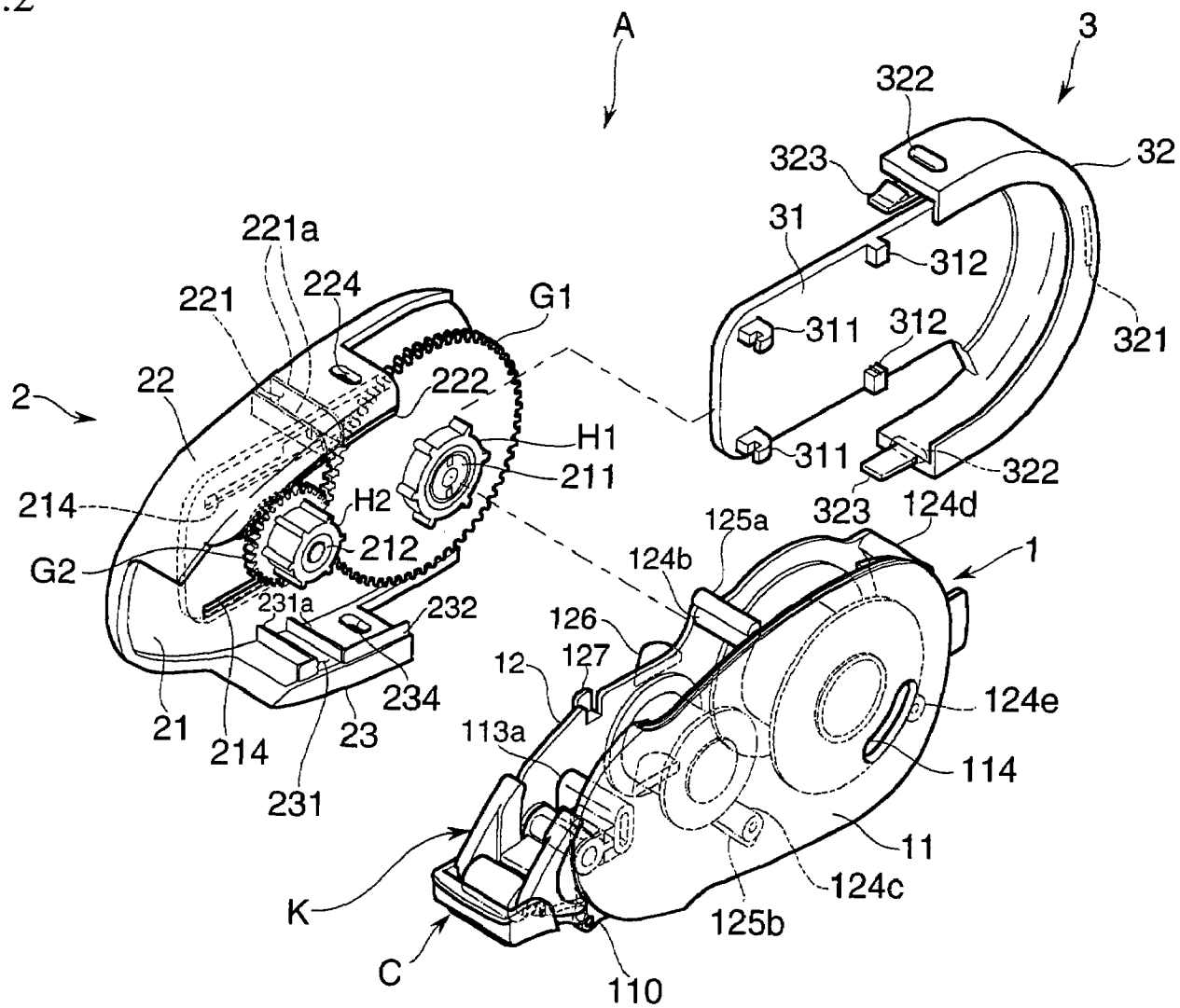
FIG. 2 is an exploded perspective view of the transfer device in accordance with the embodiment.
Figure 3:
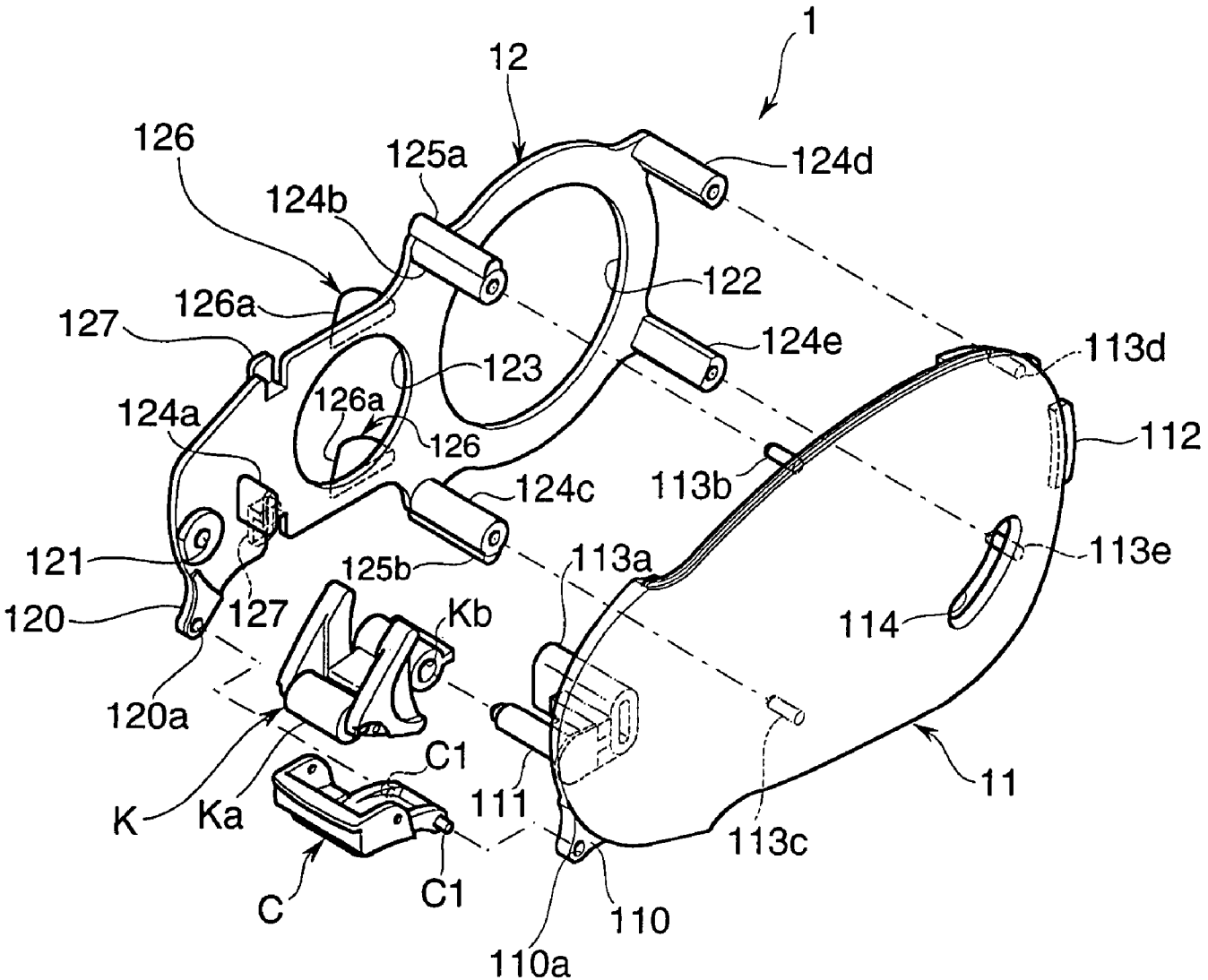
FIG. 3 is an exploded perspective view of a refillable cartridge in accordance with the embodiment.

A transfer device A in accordance with this embodiment accommodates, as shown in FIG. 1 through FIG. 3, a tape body Ta and a transferring paste T as being a transferring material that is adhered to a single face of the tape body Ta in a predetermined pattern and is used for transferring the transferring paste T on an object on which the transferring paste T is to be transferred such as papers or leaves, not shown in drawings.

The transfer device A comprises a refillable cartridge 1 that holds the transferring paste T and a transfer head K that makes the transferring paste T contact with a surface of papers or leaves, a case 2 that accommodates the refillable cartridge 1 detachably, and a sliding member 3 that is mounted on the case 2 and that can make a sliding movement relative to the case 2. It is so arranged that a refillable cartridge 1 having a used transferring paste T can be separated from the case 2 and a new refillable cartridge 1 having a new transferring paste T can be mounted on the case 2. In order to do so, the transfer device A is so arranged that the refillable cartridge 1 and the case 2 can be separated through a separating mechanism X that separates the refillable cartridge 1 linearly toward a direction orthogonal to a sliding direction the sliding member 3 in conjunction with the sliding movement of the sliding member 3. In the following explanation, a term "front" showing a position or a direction indicates a side where a transfer head K is located, and a term "back" indicates an opposite side to the position where the transfer head K is located. In addition, "a direction along back and forth" indicates a longitudinal direction of the transfer device A.

The refillable cartridge 1 comprises mainly, as shown in FIG. 1 through FIG. 3, a second outside panel 11 as being one of outer walls of the transfer device A, and an inside panel 12 arranged to face the second outside panel 11, and holds the transferring paste T mounted on a wind-off spool SP1 and a roll-up spool SP2, and the transfer head K between the second outside panel 11 and the inside panel 12.

The second outside panel 11 is, for example, in a shape of a thin plate made of synthetic resin and in this embodiment, is in a general egg-shape in a side view. A thin plate-shaped elongated portion 110 that extends downward at an angle is arranged at a front end portion of the second outside panel 11 and a through bore 110*a* into which a rotational supporting axis C11 of a head cap C, to be described later, can be inserted is formed at a general center portion of the elongated portion 110. A supporting shaft 111 that can support the transfer head K is formed to project toward a direction of the inside panel 12 at a front end portion of the inside face of the second outside panel 11. A bore portion Kb into which the supporting shaft 111 is inserted is formed on the transfer head K to correspond to the supporting shaft 111. Furthermore, a fitting nail 112 is arranged to project rearward at a rear end portion of the second outside panel 11 and the fitting nail 112 is so set to fit into a fitting bore 321, to be described later, formed on the sliding member 3 when the transfer device A is in use (when the sliding member 3 is located at a position where a sliding movement starts). In addition, supporting concave portions, not shown in drawings, each of which supports the wind-off spool SP1 and the roll-up spool SP2 respectively in a rotatable manner, are formed at predetermined areas in an inner face of the second outside panel 11.

The inside panel 12 is, for example, in a shape of a thin plate made of synthetic resin and in this embodiment, a rear end side of the inside panel 12 is a partial ark in a side view and a front end side of the inside panel 12 is a general square in a side view. Like the second outside panel 11, an elongated portion 120 that extends downward at an angle is arranged at a front end portion of the inside panel 12 and a through bore 120*a* as being a bearing portion of the present claimed invention, into which the rotational supporting axis C11 of the head cap C can be inserted, is formed at a general center portion of the elongated portion 120. In a state that the inside panel 12 and the second outside panel 11 are assembled, it is so set that the elongated portion 110 arranged on the second outside panel 11 faces the elongated portion 120 arranged on the inside panel 12 and the head cap C can make a rotary movement around the rotational supporting axis C11 by inserting the rotational supporting axis C11 into the through bore 110*a* of the elongated portion 110 and the through bore 120*a* of the elongate portion 120. The head cap C is so set to be rotatable between a transfer head covering position where a distal end portion Ka of the transfer head K is covered when the transfer device A is not in use and a transfer head exposing position where the distal end portion Ka of the transfer head K is exposed and tied up with the case 2 when the transfer device A is in use. FIG. 1 shows a state that the head cap C is positioned at the transfer head covering position. In addition, a bore 121 is formed at a front end portion of the inside face of the inside panel 12 to accept a distal end portion of the supporting shaft 111 that is formed on the second outside panel 11 and that supports the transfer head K. In addition, supporting bores 122, 123 that can support each of the wind-off spool SP1 and the roll-up spool SP2 in a rotatable manner are formed to open at a rear end portion side and a center portion of the inside panel 12 respectively. A diameter of the supporting bore 122 for the wind-off spool SP1 is made to be larger than a diameter of the supporting bore 123 for the roll-up spool SP1 in order to correspond to each diameter of the wind-off spool SP1 and the roll-up spool SP2 respectively. Each of the wind-off spool SP1 and the roll-up spool SP2 is in a general cylindrical shape with a fringe integrally formed and supported between the inside panel 12 and the second outside panel 11 in a rotatable manner with each of one end portion thereof inserted into the supporting bores 122, 123 and each of the other end portion thereof inserted into the supporting concave.

The second outside panel 11 and the inside panel 12 are in a fitting arrangement, as shown in FIG. 3. In order to do so, a cylindrical portion 113*a* and small projections 113*b*, 113*c*, 113*d*, 113*e* are formed at an inside face of the second outside panel 11 to project toward the inside panel 12 and a small projection 124*a*, which can fit into the cylindrical portion 113*a*, and cylindrical portions 124*b*, 124*c*, 124*d*, 124*e*, each of which can fit over each of the small projections 113*b*, 113*c*, 113*d*, 113*e* respectively are formed at an inside face of the inside panel 12 to project toward the second outside panel 11. More concretely, the cylindrical portion 113*a* in a compressed shape is formed at the front end portion of the second outside panel 11, the small projections 113*b*, 113*c* are formed at vertical two positions of a general center along back and forth thereof, and the small projections 113*d*, 113*e* are formed at a rear end portion with a predetermined distance kept vertically. Each of the small projections 113*b*, 113*c*, 113*d*, 113*e* is in a shape of a small column with a small projecting height. The small projections 124*a* and the cylindrical portions 124*b*, 124*c*, 124*d*, 124*e* are arranged at predetermined positions on the inside panel 12 so as to correspond to each shape and each portion of the cylindrical portion 113*a* and the small projections 113*b*, 113*c*, 113*d*, 113*e*. The small projection 124*a* locating at the front end portion is in a thin plate shape to correspond to a shape of the cylindrical portion 113*a* and each of the cylindrical portions 124*b*, 124*c*, 124*d*, 124*e* is in a general cylinder. In addition, the small projection 124*a* and the cylindrical portions 124*b*, 124*c*, 124*d*, 124*e* are arranged at a peripheral portion of the inside panel 12. In this embodiment, projecting portions 125*a*, 125*b* as being a guided portion are integrally arranged on an outer circumferential face of the cylindrical portions 124*b*, 124*c* arranged vertically at a general center along back and forth. Each of the projecting portions 125*a*, 125*b* is in a shape of a partial ark in a plane view wherein the projecting portion 125*a* projects upward from the outer circumferential face of the cylindrical portion 124*b* and the projecting portion 125*b* projects downward from the outer circumferential face of the cylindrical portion 124*c*. In a state that the second outside panel 11 and the inside panel 12 are assembled, an upper edge of the projecting portion 125*a* is located a little below an upper edge of the second outside panel 11 and a lower edge of the projecting portion 125*b* is located a little above a lower edge of the second outside panel 11.

The case 2 mainly comprises, as shown in FIG. 1 and FIG. 2, a first outside panel 21 constituting an outside wall of the transfer device A in pairs with the second outside panel 11 and a pair of standing panels 22, 23 arranged to an upper edge and a lower edge of the first outside panel 21 generally orthogonal to the first outside panel 21. Vertically arranged a pair of the standing panels 22, 23 are so set to generally close a space between the upper edge and the bottom edge of the second outside panel 11 in a state that the refillable cartridge 1 and the case 2 are assembled.

The first outside panel 21 is, like the second outside panel 11, for example, in a shape of a thin plate made of synthetic resin and is so arranged that a sliding member 3, to be described later, can be mounted on a rear end portion of the first outside panel 21, and in this embodiment, a side view in a state wherein the sliding member 3 is mounted on its rear end portion generally corresponds to a side view of the second outside panel 11 of the refillable cartridge 1. A wind-off gear G1 with a big diameter to drive to rotate the wind-off spool SP1 and the roll-up spool SP2 and a roll-up gear G2 that gears the wind-off gear G1 and that has a diameter smaller than that of the wind-off gear G1 are arranged at an inside face of the first outside panel 21. The wind-off gear G1 is mounted on an inside face of the first outside panel 21 by inserting a shaft 211 formed at the rear end portion of the first outside panel 21 into a through bore formed at a center portion of the wind-off gear G1 and then mounting a core H1 on the shaft 211 in a manner incapable of dropping out. The roll-up gear G2 has a core H2 integrally formed with the roll-up gear G2 and is mounted on the inside face of the first outside panel 21 by inserting a shaft 212 formed at a center portion along back and forth a little approaching the front end portion of the first outside panel 21 into a through bore formed at a center portion of the roll-up gear G2. A periphery of the core H1 gears an inner circumference of the wind-off spool SP1 and a periphery of the core H2 gears an inner circumference of the roll-up spool SP2 when the case 2 fits over the refillable cartridge 1. In addition, the slits 214 each of which extends back and forth are arranged vertically in pairs at a center portion of the first outside panel 21 and the sliding member 3, to be described later, is mounted in a manner of sliding movable along back and forth by making use of these slits 214.

Each of the standing panels 22, 23 has a predetermined thickness respectively and is integrally provided with grooves 221, 231 as being a guiding portion in the present claimed invention into which the projecting portions 125*a*, 125*b* arranged on the inside panel 12 of the refillable cartridge 1 can fit, and abutting members 222, 232 with which a peripheral portion of the inside face of the second outside panel 11 can make an abutting contact. The grooves 221, 231 are formed between a pair of ribs 221, and between a pair of ribs 231 each of which is arranged along a standing direction of the standing panel 22, 23, respectively, at predetermined portions corresponding to portions where the projecting portions 125*a*, 125*b* are arranged. Each groove 221, 231 is an opening edge whose one end portion opens toward the refillable cartridge 1 and is so arranged that the projecting portions 125*a*, 125*b* of the refillable cartridge 1 can be mounted or dismounted by making use of the opening edge. Each abutting member 222, 232 is formed at a distal end portion of the standing panel 22, 23 to project a little toward other standing panel 23, 22 generally parallel to the first outside panel 21. Each abutting member 222, 232 is arranged neither between the ribs 221*a*, nor between the ribs 231*a*. An opening edge of each abutting members 222, 232 opens toward the refillable cartridge 1. The abutting member 222, 232 is thin-walled so as to make the outside face of the standing panel 22, 23 and the outside face of the second outside panel 11 generally flat when the refillable cartridge 1 fits into the case 2.

The sliding member 3 is, as shown in FIG. 1 through FIG. 3, in a shape of an "L" character of synthetic resin comprising a side panel 31 that makes a sliding movement along a pair of vertically arranged slits 214 formed on the first outside panel 21, namely along a direction of back and forth of the first outside panel 21, and that is arranged along an outside face of the first outside panel 21, and an integrally formed operating panel 32 that is integrally formed with the side panel 31 and that is arranged to cover generally whole area of the rear end portion side of the case 2. An outside face of the side panel 31 is arranged so as to be flat to the outside face of the first outside panel 21. In order to do so, a predetermined area around the slit 214 on the outside face of the first outside panel 21 is dent to correspond to a shape of the side panel 31. In addition, the operating panel 32 is generally in a shape of a partial ark in a side view and bent along a shape of the rear end portion of the standing panel 22, 23 of the case 2. The fitting bore 321, into which the fitting nail 112 arranged at the rear end portion of the second outside panel 11 of the refillable cartridge 1 fits, is formed at a center portion of the inside face of the operating panel 32 and a pair of operating portions 322 are formed at both end portions on the outside face of the operating panel 32. In this embodiment, the operating portion 322 projects outward in order to facilitate hanging a user's finger, however, it may have a partial concave portion on its outside face. In addition, an unciform engaging member 323 is formed at one end portion of each operating panel 32 to project forward. At the rear end portion of the standing panel 22, 23 the case 2 has engaging bores 224, 234 that can make an engagement with the engaging member 323 in order to correspond to the sliding member 3 of the above arrangement. An engaging means of the present claimed invention is constituted by a pair of the engaging members 323, 323 and the engaging bores 224, 234 corresponding to the engaging members 323, 323. The sliding member 3 is stably held by the case 2 at a position where a sliding movement starts by engaging the engaging members 323, 323 with the engaging bores 224, 234 respectively. In accordance with the above-mentioned arrangement, the sliding member 3 is closely related to the refillable cartridge 1 due to a fitting arrangement of the fitting bore 321 and the fitting nail 112 and is engaged with the case 2 due to an engaging arrangement of the engaging member 323, 323 and the engaging bores 224, 234 in a state that the sliding member 3 is mounted on the case 2 and that the refillable cartridge 1 is assembled with the case 2.

When the transfer device A is slid toward a predetermined direction with contacting a surface of a paper or the like, the tape A held between the distal end portion Ka of the transfer head K and the surface of the paper is sent out from the wind-off spool SP1 that rotates together with the wind-off gear G1 due to frictional force and the paste adhered to one face of the tape body Ta is transferred on the surface of the paper. At the same time, the roll-up spool SP2 rotates together with the roll-up gear G2 that rotates to a counter direction in conjunction with the wind-off gear G1, and the tape body Ta that does not have paste on its face is rolled up by the roll-up spool SP1. If an appropriate tool or a writing material that has a spiculate portion at its distal end such as a driver or a pen is inserted into a chamfer, not shown in drawings, arranged intermittently along a circumference of the outside face of the roll-up spool SP1, and then the roll-up spool SP1 is rotated by the use of the appropriate tool or the writing material, a slack of the transferring paste T in the transfer device A can be adjusted due to a rotation of the wind-off spool SP2 in conjunction with the rotation of the roll-up spool SP1.

The transfer device A is so arranged that the refillable cartridge 1 and the case 2 can be separated by sliding the sliding member 3 toward a predetermined direction and a separating mechanism X is formed by making the refillable cartridge 1, the case 2 and the sliding member 3 mutually related. The separating mechanism X comprises a pair of projecting portions 311, 311 vertically arranged on an inside face of the side panel 31 so as to be inserted into the slits 214 vertically arranged on the case 2, and a pair of separation initiating portions 126, 126 vertically arranged on the inside panel 12 of the refillable cartridge 1 to face the case 2. Each of the separation initiating portions 126 is in a shape of a thin plate with forming a tapered face 126*a* inclining toward the front. In this embodiment, the tapered face 126*a* is generally in a partial arc in a plane view with forming a modest curve. Each of the separation initiating portion 126 is inserted into the slit 214 as being a traveling path of the projecting portion 311 so as to be in ready. Each of the projecting portion 311 is in an unciform shape of a thin plate with forming a tapered face 311*a* inclining toward the rear. The tapered face 311*a* is generally in a partial arc with forming a modest curve corresponding to the tapered face 126*a* of the separation initiating portion 126. In addition an accommodating portion 127 is formed on the outside face of the inside panel 12 that can accommodate a distal end portion of the projecting portion 311 in a state that the sliding member 3 is located at a sliding start position in order to hold the sliding member 3 at the sliding start position when the transfer device A is in use.

In order to avoid the sliding member 3 from dropping out in conjunction with a sliding movement of the sliding member 3, a pair of small projecting portions 312, 312 are formed vertically on the sliding member 3 to be inserted into the slits 214 at a position rearward to the projecting portion 311 so as to make an abutting contact with a stopper portion, not shown in drawings, formed on the slit 214 when the sliding member 3 is slid rearward by a predetermined distance (at a sliding end position). The stopper portion may be such that an opening width of the slit 214 is set to be narrow so that the small projecting portion 311 makes an abutting contact or that an opening edge of the slit 214 is utilized.

Figure 4:
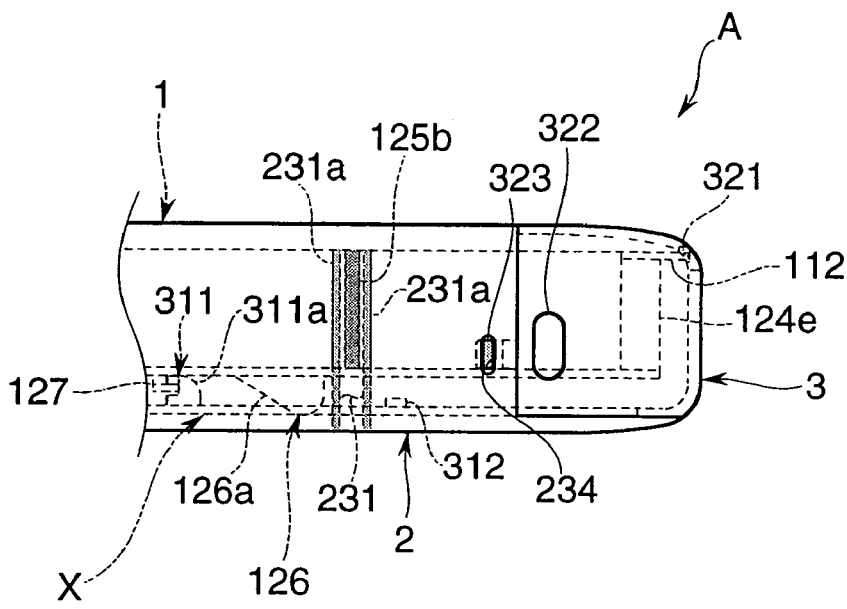
FIGS. 4(*a*) and 4(*b*) are exploded perspective views showing a cartridge of the transfer device in a two different positions in accordance with the embodiment.
Figure 4:
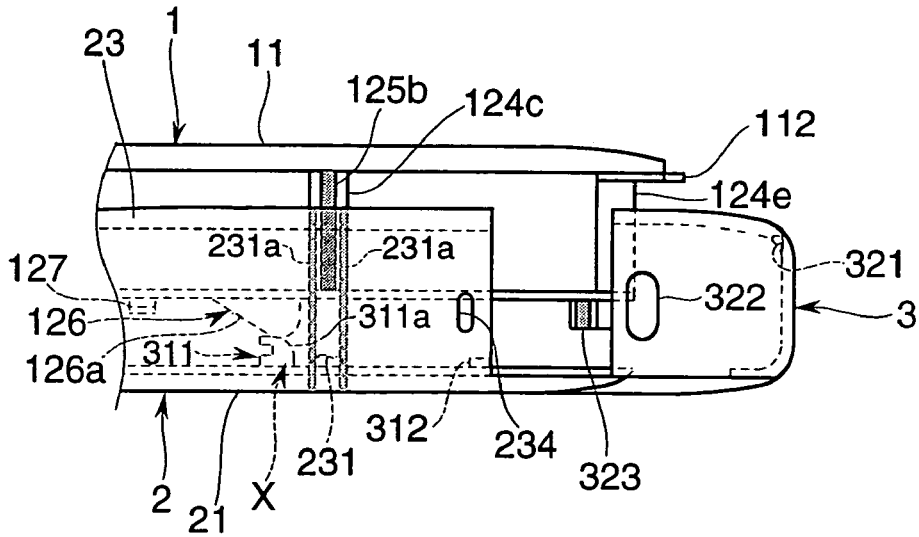

Next, a procedure to separate the refillable cartridge 1 from the case 2 will be explained with reference to FIG. 4. FIG. 4 is a magnified plane view of a principal part with some part omitted to draw. First, in a state that the refillable cartridge 1 and the case 2 are assembled (refer to FIG. 4(*a*)), the standing panels 22, 23 of the case 2 are held with one hand and the sliding member 3 locating at the sliding start position is slid rearward relative to the case 2 with pushing a pair of the operating portions 322, 322 arranged on the sliding member 3 to approach each other with the other hand. In conjunction with this operation, an engaged state of the engaging member 323 and the engaging bore 224, 234 (an engaged state by the engaging means) and an engaged state of the fitting nail 112 and the fitting bore 321 are released respectively, and then the projecting portion 311 of the sliding member 3 starts to interfere the separation initiating portion 126 arranged on the inside panel 12 of the refillable cartridge 1. Additional movement to slide the sliding member 3 rearward makes the tapered face 311*a* of the projecting portion 31 abutting contact with the tapered face 126*a* of the separation initiating portion 126 and the sliding member 3 climbs over the inside panel 12 of the refillable cartridge 1 little by little (refer to FIG. 4(*b*)). In this case, a pair of the projecting portions 125*a*, 125*b* arranged on the inside panel 12 are guided by the grooves 221, 231 formed on the standing panels 22, 23 of the case 2 so that the refillable cartridge 1 is gradually separated from the case 2 toward a direction orthogonal to the direction of sliding the sliding member 3 in a generally linear manner. When the sliding member 3 reaches the sliding end position by further making a sliding movement rearward by a predetermined distance, the small projecting portion 312 of the sliding member 3 makes an abutting contact with a stopper portion, not shown in drawings, formed in the slit 214, which restrains the sliding member 3 from further making a sliding movement. In this state, the refillable cartridge 1 and the case 2 can be separated by moving the refillable cartridge 1 along a direction generally orthogonal to the direction of sliding the sliding member 3. In order to mount a new refillable cartridge 1 on the case 2, all needed is just to move the new refillable cartridge 1 to gradually approach the case 2 with the projecting portion 125*a*, 125*b* of the new refillable cartridge 1 guided by the grooves 221, 231 formed on the standing panels 22, 23 of the case 2. In conjunction with this operation, the new refillable cartridge 1 moves in a generally linear state along a direction generally orthogonal to the direction of sliding the sliding member 3 and then the inside face of the second outside panel 11 of the new refillable cartridge 1 makes an abutting contact with the abutting members 222, 232 arranged on the standing panels 22, 23 of the case 2. (The abutting member is omitted to draw in FIG. 4.) In this case, each of the grooves 221, 231 also serves as a mounting guiding portion for suggesting a portion on which the new refillable cartridge 1 be mounted. Furthermore, when the new refillable cartridge 1 is mounted on the case 2, first, the sliding member 3 is moved toward the sliding starting position beforehand; next, the new refillable cartridge 1 is mounted on the case 2; and then the sliding member 3 is moved further forward until it reaches the sliding starting position. Due to this operation, the fitting nails 112 arranged on the outside panel 11 of the new refillable cartridge 1 fits into the fitting bore 321 formed on the sliding member 3, and the engaging bore 224, 234 engages with the engaging member 323 arranged on the sliding member 3, which assures a stable state of the new refillable cartridge 1 mounted on the case 2. In addition, in order to mount the new refillable cartridge 1 on the case 2, when the sliding member 3 is located at the sliding end position, the following operation may be conducted; the new refillable cartridge 1 may be moved to approach the case 2 with the projecting portions 125*a*, 125*b* of the new refillable cartridge 1 guided by the grooves 221, 231 of the case 2, which transitionally makes the tapered face 126*a* of the separation initiating portion 126 of the new refillable cartridge 1 interfere the tapered face 311*a* of the projecting portion 311 of the sliding member 3 each other, and the new refillable cartridge 1 is further moved to approach the case 2. In conjunction with this operation, the sliding member 3 makes a sliding movement forward relative to the case 2.

As mentioned above, since the transfer device A in accordance with this embodiment is so arranged that the refillable cartridge 1 and the case 2 are separated through the separating mechanism X that moves the refillable cartridge 1 linearly generally toward the direction orthogonal to the sliding direction of the sliding member 3 in conjunction with the sliding movement of the sliding member 3, the refillable cartridge 1 moves linearly to be separated from the case 2. Then a movement of the refillable cartridge 1 can be simplified compared with a case wherein a refillable cartridge is rotated by making use of a predetermined portion as a fulcrum in order to be separated from the cartridge, and a method for separating the refillable cartridge 1 from the case 2 is easily grasped, thereby to improve usability. As a result, it is possible to separate the refillable cartridge 1 from the case 2 easily, which makes it easy to exchange the transfer paste T and the transfer head K. In addition, since the grooves 221, 231 are arranged on the case 2 to extend along a direction orthogonal to the sliding direction of the sliding member 3 and the projecting portions 125*a*, 125*b* are arranged on the refillable cartridge 1 to be guided by the grooves 221, 231 in conjunction with the sliding movement of the sliding member 3, the projecting portions 125*a*, 125*b* can be guided by the grooves 221, 231 during a process of separating the refillable cartridge 1 from the case 2 or during a process of mounting a new refillable cartridge 1 on the case 2, thereby enabling to make the linear movement of the refillable cartridge 1 more stable and to make an operation to exchange the refillable cartridge 1 smooth and precisely. In addition, since the grooves 221, 231 play a role to recognize a position on which the refillable cartridge 1 is to be mounted (a position where a new exchanged refillable cartridge 1 is mounted), an operation to exchange the refillable cartridge 1 can be further simplified effectively. In addition, since the refillable cartridge 1 holds the transfer paste T and the transfer head K, a user can easily know which component is to be exchanged and an operation to exchange each component can be carried out with ease.

In addition, since the separating mechanism X comprises the projecting portion 311 formed on the sliding member 3 and the separation initiating portion 126 that is arranged on a line of the sliding movement of the projecting portion 311 in the case 2 and that makes an abutting contact with the projecting portion 311 in conjunction with the sliding movement of the sliding member 3 so as to separate the refillable cartridge 1 linearly from the sliding member 3 toward a direction generally orthogonal to the sliding movement, it is possible to separate the refillable cartridge 1 from the case in conjunction with the sliding movement of the sliding member 3 with a simple arrangement. Especially, since the tapered faces 311*a*, 126*a* are formed to make an abutting contact with the projecting portion 311 and the separation initiating portion 126 respectively during a process of the sliding movement of the sliding member 3, the tapered face 311*a* of the projecting portion 311 climbs over the tapered face 126*a* of the separation initiating portion 126 in accordance with the sliding movement of the sliding member 3 and this movement makes it possible to separate the refillable cartridge 1 from the case 2 with ease.

Furthermore, since the case 2 comprises the first outside panel 211 constituting one of the outside walls of the transfer device A and the standing panels 22, 23 that stand from the predetermined area of the peripheral edge of the first outside panel 21 toward a direction generally orthogonal to the first outside panel 21 and the grooves 221, 231 are formed on the standing panel 22, 23, it is possible for the standing panels 22, 23 to hold the refillable cartridge 1 stably by preventing the refillable cartridge 1 from being unexpectedly separated from the case 2 when the transfer device A is in use and also possible to exchange the refillable cartridge 1 with ease by making use of the standing panels 22, 23. In addition, since the grooves 221, 231 are formed between a pair of the ribs 221*a*, 231*a*, each rib 221*a*, 231*a* serves as a reinforcing portion to reinforce the standing panels 22, 23, thereby enabling to enhance the strength of the standing panels 22, 23 effectively. Since the standing panels 22, 23 can be made thin as far as an effective strength is not failed, a freedom to design the case 2 can be increased.

In addition, since the second outside panel 11 and the inside panel 12 are integrally assembled by fittingly inserting the cylindrical portions 113*a*, small projections 113*b*, 113*c*, 113*d*, 113*e* arranged on the second outside panel 11 over the small projections 124*a* or into the cylindrical portions 124*b*, 124*c*, 124*d*, 124*e* arranged on the inside panel 12, it is possible to integrally assemble the second outside panel 11 and the inside panel 12 and also possible to make a state where the second outside panel 11 and the inside panel 12 are assembled good. As a result, a problem that might occur when the second outside panel 11 and the inside panel 12 are separated, namely, a problem that the transfer paste T and the transfer head K held between the second outside panel 11 and the inside panel 12 are scattered can be avoided.

Especially, since the projecting portions 125*a*, 125*b* are integrally formed on the outer face of the cylindrical portions 124*b*, 124*c*, the projecting portions 125*a*, 125*b* serve as a rib to reinforce the cylindrical portions 124*b*, 124*c*, thereby reinforcing the cylindrical portions 124*b*, 124*c*.

In addition, since the grooves 221, 231 are arranged in pairs to face each other in the areas near the upper edge portion of the case 2 and near the lower edge portion of the case 2 and the projecting portions 125*a*, 125*b* are arranged in pairs to face each other in the areas near the upper edge portion of the refillable cartridge 1 and near the lower edge portion of the refillable cartridge 1, the refillable cartridge 1 can be separated stably and a process of manufacturing the transfer device A can be simplified effectively by minimizing a number of grooves and the projecting portions.

Furthermore, since the operating portion 322 to hook a user's finger when the sliding member 3 is operated to make a sliding movement is arranged on the sliding member 3 and the engaged state of the sliding member 3 and the case 2 at the sliding start position by the engaging means can be released in accordance with the operation of the operating portion 322, it is possible to closely relate the sliding member 3 with the case 2 at the sliding start position, thereby enabling to prevent the sliding member 3 from moving relative to the case 2 when the transfer device A is in use (in a state where the sliding member 3 is located at the sliding start position).

In addition, since the refillable cartridge 1 has the fitting nail 112 projecting along the sliding direction of the sliding member 3 when the refillable cartridge 1 is separated from the case 2 and the sliding member 3 has the fitting bore 321 into which the fitting nail 112 can fit at the sliding start position, it is possible to prevent the refillable cartridge 1 from detaching unexpectedly from the case 2 when the transfer device A is in use (in the state where the sliding member 3 is located at the sliding start position).

The present claimed invention is not limited to the above-described embodiments.

For example, the refillable cartridge may be separated from the case through a separation mechanism that separates the refillable cartridge toward a direction at a predetermined angle toward the sliding direction of the sliding member linearly. In accordance with the arrangement, since the refillable cartridge can be moved linearly, the same effect can be obtained as that of the above embodiment. In this case, a guide portion (the groove in the above embodiment) may be arranged along the predetermined angle.

In addition, in the above embodiment, the grooves are formed between a pair of ribs arranged on the standing panels, however, a predetermined portion of the standing panels may be set to be thinner than its adjacent portion so as that the predetermined portion serves as a concave groove.

Furthermore, an opening width of the groove may be set to open wider gradually toward an opening edge opening at a side of the refillable cartridge. In accordance with this arrangement, it is possible to insert the projecting portion as being the guided portion into the groove with ease, thereby enabling to exchange the refillable cartridge more easily and smoothly.

A number of the guiding portion and the guided portion (a position where each of the guiding portion and the guided portion is formed) may be one and over and increased or decreased arbitrary.

Furthermore, the refillable cartridge may be so arranged that a cylindrical portion is arranged on an outside panel constituting the refillable cartridge and a projecting body that can fit into the cylindrical portion is arranged on an inside panel, wherein the outside panel and the inside panel can be integrally assembled by inserting the projecting body into the cylindrical portion.

In addition, the transfer paste as the transferring material may be solid or liquid, and can be applied to a correction tape, an adhesive tape, a tape that does not have adhesiveness, a binding material, and a general transferring material to be transferred to an object on which the transferring material is to be transferred.

In addition, in the above-mentioned embodiment, the transfer head to make the transferring material contact with the object on which the transferring material is to be transferred is held by the refillable cartridge, however, the transfer head may be mounted on the case. In this case, the refillable cartridge holds at least the transferring material and a used transferring material can be exchanged to a new transferring material by exchanging the refillable cartridge.

Other concrete arrangement is not limited to the above embodiments and may be variously modified without departing from the spirit of the invention.

As mentioned above, in accordance with the transfer device of the present claimed invention, since the refillable cartridge can be separated linearly from the case toward a predetermined direction different from the sliding direction of the sliding member by sliding to move the sliding member, it is possible to exchange the refillable cartridge with ease, thereby enabling to exchange a new transfer device easily. Especially, since the guided portion is guided by the guiding portion extending toward the predetermined direction different from the sliding movement of the sliding member, it is possible to exchange the refillable cartridge smoothly and accurately. In addition, since the guiding portion plays a role to recognize a position on which the refillable cartridge is to be mounted, an operation to exchange the refillable cartridge can be further simplified effectively. Furthermore, since the refillable cartridge and the sliding member are formed separately from the case, a component to be exchanged, namely, the refillable cartridge can be easily recognized, thereby enabling to facilitate a process of exchanging the refillable cartridge.

The invention claimed is:

1. A transfer device for transferring a transferring material to an object comprising a refillable cartridge that holds at least the transferring material, a case that accommodates the refillable cartridge detachably, a sliding member that is mounted on the case and that can make a sliding movement relative to the case, and a separating mechanism that separates the refillable cartridge from the case wherein the separating mechanism moves the refillable cartridge linearly in a direction that is different from a sliding direction of the sliding member when the sliding member makes the sliding movement, wherein the case comprises a guiding portion that extends in the direction different from the sliding direction of the sliding member and the refillable cartridge comprises a guided portion that is guided by the guiding portion when the sliding member makes the sliding movement.

2. The transfer device described in claim 1, wherein the direction different from the sliding direction of the sliding member is a direction generally orthogonal to the sliding direction of the sliding member and the guiding portion extends along the direction generally orthogonal to the sliding direction of the sliding member.

3. The transfer device described in claim 1, wherein the separating mechanism comprises a projecting portion formed on the sliding member, and a separation initiating portion arranged on a sliding movement path of the projecting portion of the refillable cartridge and making an abutting contact with the projecting portion in accordance with the sliding movement of the sliding member and separating the refillable cartridge linearly in the direction different from the sliding direction of the sliding member.

4. The transfer device described in claim 3, wherein each tapered face is formed on the projecting portion and the separation initiating portion respectively and the tapered faces make an abutting contact with each other during the sliding movement of the sliding member.

5. The transfer device described in claim 3, wherein the refillable cartridge comprises a transfer head that contacts the transferring material with the object and wherein the sliding direction of the sliding member to separate the refillable cartridge from the case is a direction opposite to a longitudinal axis of the transfer head.

6. The transfer device described in claim 1, wherein the case comprises a first outside panel constituting one of outside walls of the transfer device and a standing panel standing generally orthogonal to the first outside panel from an area of a rim of the first outside panel, and the guiding portion is formed on the standing panel.

7. The transfer device described in claim 6, wherein the guiding portion is a groove and the guided portion is a projecting portion that fits into the groove.

8. The transfer device described in claim 7, wherein the groove is formed between a pair of ribs arranged on the standing panel.

9. The transfer device described in claim 7, wherein the groove is a concave groove formed by setting a thickness of an area of the standing panel to be thinner than a thickness of its adjacent area.

10. The transfer device described in claim 7, wherein the groove has an opening edge opening at one of the end portions of the groove and wherein the projecting portion can be inserted from the opening edge, and an opening width of the groove is gradually wider toward the opening edge.

11. The transfer device described in claim 1, wherein the refillable cartridge comprises a second outside panel constituting an outside wall of the transfer device and an inside panel facing the second outside panel and at least the transferring material is held by the second outside panel and the inside panel.

12. The transfer device described in claim 11, wherein the second outside panel and the inside panel are integrally assembled by fittingly inserting a projecting body attached to one of the second outside panel and the inside panel into a cylindrical portion on the other.

13. The transfer device described in claim 12, wherein the guiding portion is a groove, the guided portion is a projecting portion that fits into the groove and the projecting portion is integrally arranged on a periphery of the cylindrical portion.

14. The transfer device described in claim 1, wherein the case comprises multiple guiding portions and the refillable cartridge comprises multiple guided portions corresponding to the guiding portions.

15. The transfer device described in claim 1, wherein the guiding portions comprise a pair of guiding portions arranged to face each other in an area adjacent to an upper edge portion of the case and an area adjacent to a lower edge portion of the case and the guided portions comprise a pair of guided portions arranged to face each other in an area adjacent to an upper edge portion of the refillable cartridge and an area adjacent to a lower edge portion of the refillable cartridge.

16. The transfer device described in claim 1, wherein an engaging means engages the sliding member with the case at a sliding movement starting position, an operating portion to slide the sliding member and operable by a user's finger wherein an engaged state of the engaging means can be released in accordance with an operation of the operating portion.

17. The transfer device described in claim 1, wherein the refillable cartridge comprises a fitting nail projecting along the sliding direction of the sliding member and the sliding member comprising a fitting bore to fit over the fitting nail at a sliding movement starting position.

18. A transfer device for transferring a transferring material to an object comprising a refillable cartridge that holds the transferring material and a transfer head to contact the transferring material with the object, a case that accommodates the refillable cartridge detachably, and a sliding member that is mounted on the case and that can make a sliding movement relative to the case, and separating mechanism that separates the refillable cartridge from the case wherein the separating mechanism moves the refillable cartridge linearly in a direction that is different from a sliding direction of the sliding member when the sliding member makes the sliding movement wherein the case comprises a guiding portion that extends in the direction different from the sliding direction of the sliding member and the refillable cartridge comprises a guided portion that is guided by the guiding portion when the sliding member makes the sliding movement.

19. The transfer device described in claim 18, wherein the direction different from the sliding direction of the sliding member is a direction generally orthogonal to the sliding direction of the sliding member and the guiding portion extends along the direction generally orthogonal to the sliding direction of the sliding member.

20. The transfer device described in claim 18, wherein the separating mechanism comprises a projecting portion formed on the sliding member, and a separation initiating portion arranged on a sliding movement path of the projecting portion of the refillable cartridge and making an abutting contact with the projecting portion in accordance with the sliding movement of the sliding member and separating refillable cartridge linearly in the direction different from the sliding direction of the sliding member.

21. The transfer device described in claim 20, wherein each tapered face is formed on the projecting portion and the separation initiating portion respectively and the tapered faces make an abutting contact with each other during the sliding movement of the sliding member.

22. The transfer device described in claim 20 wherein the sliding direction of the sliding member to separate the refillable cartridge from the case is a direction opposite to a longitudinal axis of the transfer head.

23. The transfer device described in claim 18, wherein the case comprises a first outside panel constituting one of outside walls of the transfer device and a standing panel standing generally orthogonal to the first outside panel from an area of a rim of the first outside panel, and the guiding portion is formed on the standing panel.

24. The transfer device described in claim 23, wherein the guiding portion is a groove and the guided portion is a projecting portion that fits into the groove.

25. The transfer device described in claim 24, wherein the groove is formed between a pair of ribs arranged on the standing panel.

26. The transfer device described in claim 24, wherein the groove is a concave groove formed by setting a thickness of an area of the standing panel to be thinner than a thickness of its adjacent area.

27. The transfer device described in claim 24, wherein the groove has an opening edge opening at one of the end portions of the groove and wherein the projecting portion can be inserted from the opening edge, and an opening width of the groove is gradually wider toward the opening edge.

28. The transfer device described in claim 18, wherein the refillable cartridge comprises a second outside panel constituting an outside wall of the transfer device and an inside panel facing the second outside panel and at least the transferring material is held by the second outside panel and the inside panel.

29. The transfer device described in claim 28, wherein the second outside panel and the inside panel are integrally assembled by fittingly inserting a projecting body arranged to one of the second outside panel and the inside panel into a cylindrical portion on the other.

30. The transfer device described in claim 29, wherein the guiding portion is a groove, the guided portion is a projecting portion that fits into the groove and the projecting portion is integrally arranged on a periphery of the cylindrical portion.

31. The transfer device described in claim 18, wherein the case comprises multiple guiding portions and the refillable cartridges comprises multiple guided portions corresponding to the guiding portions.

32. The transfer device described in claim 18, wherein the guiding portions comprise a pair of guiding portions arranged to face each other in an area adjacent to an upper edge portion of the case and an area adjacent to a lower edge portion of the case and the guided portions comprise a pair of guided portions arranged to face each other in an area adjacent to an upper edge portion of the refillable cartridge and an area adjacent to a lower edge portion of the refillable cartridge.

33. The transfer device described in claim 18, wherein an engaging means engages the sliding member with the case at a sliding movement starting position, an operating portion to slide the sliding member and operable by a user's finger wherein an engaged state of the engaging means can be released in accordance with an operation of the operating portion.

34. The transfer device described in claim 18, wherein the refillable cartridge comprises a fitting nail projecting along the sliding direction of the sliding member and the sliding member comprising a fitting bore to fit over the fitting nail at a sliding movement starting position.

* * * * *